US009500173B2

(12) United States Patent
Casey et al.

(10) Patent No.: US 9,500,173 B2
(45) Date of Patent: Nov. 22, 2016

(54) METHOD AND DEVICE FOR MONITORING AN ENGAGEMENT PROCESS OF AN ENGAGING PINION OF A STARTER MOTOR

(75) Inventors: Simon Casey, Caulfield (AU); Tony Rocco, Chelsea (AU)

(73) Assignee: Robert Bosch GmbH, Stuttgart (DE)

( * ) Notice: Subject to any disclaimer, the term of this patent is extended or adjusted under 35 U.S.C. 154(b) by 344 days.

(21) Appl. No.: 14/131,481

(22) PCT Filed: Jun. 19, 2012

(86) PCT No.: PCT/EP2012/061666

§ 371 (c)(1),
(2), (4) Date: Apr. 21, 2014

(87) PCT Pub. No.: WO2013/007480

PCT Pub. Date: Jan. 17, 2013

(65) Prior Publication Data

US 2014/0236453 A1 Aug. 21, 2014

(30) Foreign Application Priority Data

Jul. 8, 2011 (DE) ..... 10 2011 078 837

(51) Int. Cl.
*F02N 11/08* (2006.01)
*F02D 41/14* (2006.01)
*F02D 41/28* (2006.01)

(52) U.S. Cl.
CPC ..... *F02N 11/08* (2013.01); *F02N 11/0848* (2013.01); *F02N 11/0851* (2013.01);
(Continued)

(58) Field of Classification Search
CPC ..... F02N 11/0848; F02N 11/0851; F02N 11/0855; F02N 2200/044
USPC ..... 701/101, 113; 123/179.4
See application file for complete search history.

(56) References Cited

U.S. PATENT DOCUMENTS 4,947,051 A * 8/1990 Yamamoto ..... F02N 11/0848 123/179.3
5,743,227 A * 4/1998 Jacquet ..... F02N 11/0848 123/179.3

(Continued)

FOREIGN PATENT DOCUMENTS

CN 101354001 A 1/2009
CN 102112729 A 6/2011

(Continued)

OTHER PUBLICATIONS

Fagan A D: "An introduction to the fast Fourier transform", Marconi Review, vol. 42, No. 212, Jan. 1, 1979, pp. 38-47, XP009114530.

(Continued)

*Primary Examiner* — Erick Solis
(74) *Attorney, Agent, or Firm* — Norton Rose Fulbright US LLP; Gerard Messina

(57) ABSTRACT

A method for monitoring an engagement process of an engaging pinion of a starter motor for a vehicle drive, in which an armature of the starter motor is moved, includes detecting a magnetic coil signal while current is applied to the magnetic coil of the magnet, in order to obtain a signal profile, particularly a current profile; generating a frequency profile by transforming the signal profile using a time-frequency transform; comparing the frequency profile to at least one reference frequency profile; and monitoring the engagement process based on the comparison.

14 Claims, 5 Drawing Sheets

(52) U.S. Cl.
CPC ... *F02N11/0855* (2013.01); *F02D 2041/1417* (2013.01); *F02D 2041/288* (2013.01); *F02N 2200/044* (2013.01); *F02N 2200/047* (2013.01); *F02N 2200/065* (2013.01)

(56) References Cited

U.S. PATENT DOCUMENTS

| | | | | |
|---|---|---|---|---|
| 5,983,850 | A * | 11/1999 | Vilou | F02N 11/0848 123/179.3 |
| 6,274,943 | B1 * | 8/2001 | Hasegawa | B60K 6/46 290/38 R |
| 6,553,816 | B1 * | 4/2003 | Palanisamy | F02D 41/22 324/378 |
| 7,061,130 | B1 * | 6/2006 | Blackburn | F02N 11/04 180/65.22 |
| 8,112,185 | B2 * | 2/2012 | Wu | B60R 25/045 123/179.12 |
| 2002/0141122 | A1 * | 10/2002 | Hisamoto | F02N 11/0848 361/25 |
| 2008/0109150 | A1 * | 5/2008 | Pfohl | F02N 11/105 701/113 |
| 2011/0202263 | A1 * | 8/2011 | Kawazu | F02N 11/0848 701/113 |

FOREIGN PATENT DOCUMENTS

| | | |
|---|---|---|
| EP | 844388 | 5/1998 |
| WO | WO 2004102600 | 11/2004 |
| WO | WO 2010015450 | 2/2010 |
| WO | 2011018340 A1 | 2/2011 |
| WO | WO 2011/080010 | 7/2011 |

OTHER PUBLICATIONS

International Search Report issued in PCT/EP2012/061666, dated Nov. 21, 2012.

Greg Welch et al: "An introduction to the Kalma filter", Technical Report, Department of Computer Science, Chapel Hill, NC 27599-3175, vol. 95, 41, Jul. 24, 2006, pp. 1-15, XP002547392.

* cited by examiner

METHOD AND DEVICE FOR MONITORING AN ENGAGEMENT PROCESS OF AN ENGAGING PINION OF A STARTER MOTOR

CROSS REFERENCE TO RELATED APPLICATION

The present application is the national stage entry of International Patent Application No. PCT/EP2012/061666, filed on Jun. 19, 2012, which claims priority to Application No. DE 10 2011 078 837.9, filed in the Federal Republic of Germany on Jul. 8, 2011.

FIELD OF INVENTION

The present invention relates to a method and a device for monitoring an engagement process of an engaging pinion of a starter motor for a vehicle drive.

BACKGROUND INFORMATION

Starters are known in which, during the starting process, an engaging pinion of the starter motor engages with a toothed wheel of a vehicle drive, particularly of an internal combustion engine.

In the ideal case, the engaging pinion of the starter motor and a corresponding toothed wheel are situated in the vehicle drive rotated with respect to each other such that the engaging pinion glides directly into the toothed wheel. It is also possible, however, that during the engagement process, one tooth of the pinion first overlaps wholly or partially with a tooth of the toothed wheel, and direct engaging is prevented thereby. In the case of a worn pinion, in particular, or a worn toothed wheel, what may happen in such a situation is that the starter motor begins to turn and the engaging pinion does not engage in the toothed wheel because of the tooth position. Or rather, the teeth of the engaging pinion and the teeth of the toothed wheel glide away over one another, so that the vehicle drive is not driven by the starter motor.

In the usual starter motors, it is checked accordingly, for example, whether an engagement process has been completed after a certain time. After this certain time, if no successful engagement process is able to be detected, the engagement process is broken off, for example, and started over again. The effect of this may, however, turn out unfavorably on the operation of starter motors in start-stop systems, in which a new start of the vehicle drive is supposed to take place in as short a time as possible.

SUMMARY

An object on which the present invention is based may therefore be seen in stating a device for monitoring an engagement process of an engaging pinion of a starter motor for a vehicle drive, by which an engagement process may be monitored in a simplified manner.

According to one aspect, a method is provided for monitoring an engagement process of an engaging pinion of a starting process for a vehicle drive, in which an armature of the starter motor is moved by a magnet. In this instance, a magnetic coil signal is detected when current is applied to a magnetic coil, in order to obtain a signal profile, especially a current profile. The magnet is a solenoid, for example. By transforming the signal profile using a time-frequency transformation, a frequency profile is generated. This frequency profile is compared to at least one reference frequency profile. The engagement process is monitored based on the comparison, for example, and based on the comparison, the quality of the engagement process is ascertained.

According to one advantageous exemplary embodiment, it is ascertained during the monitoring of the engagement process whether the engagement process has been, or is being successfully carried out. In different exemplary embodiments, the quality ascertained, or rather the monitoring of the engagement process, for instance, also includes at least one of the following: a successful engagement process being able to be carried out, a delayed running engagement process, an engagement process not successfully carried out, an engagement process not able to be successfully carried out, a tooth-upon-tooth position of the engaging pinion during the engagement process. Consequently, the quality of the engagement process may be assessed using only a slight effort.

The recording of a signal profile takes place, for example, by measuring a signal profile, particularly a current profile, on a starter relay of the starter motor. The measurement of the signal profile and of the magnetic coil signal may take place, for instance, at a terminal of the starter relay via which the magnet, for instance a solenoid, is supplied with current for attracting the armature, for this, preferably a shunt being used as measuring resistor.

Such a terminal is a so-called terminal 50 of a vehicle electrical system, for example.

It is then possible to use different measurement receiving times for the distance sensors. According to one advantageous exemplary embodiment, during the generating of the frequency profile, at least one of the following transformations is used: a discrete-time Fourier transform, particularly a fast Fourier transform, FFT, a short-time Fourier transform, SIFT, a wavelet transform. According to that, the at least one reference frequency profile is also present based on the respectively selected time frequency transform. Such reference frequency profiles may, for instance, be ascertained by the corresponding time-frequency transform ahead of time from known signal curves, so that such reference frequency profiles each correspond to an engagement process having a certain quality. By comparing the frequency profile to the reference frequency profile, similarities and deviations of the frequency profile of an instantaneous engagement process and the reference frequency profile may be ascertained, in order to determine the quality of the engagement process, and to monitor the engagement process on this matter.

For example, in one advantageous exemplary embodiment, the comparing includes ascertaining an error value, particularly based on a mean square error between the frequency profile and the at least one reference frequency profile. The engagement process is monitored, for instance, based on the error value ascertained. The error value may, in particular, give information as to whether the engagement process is able to be carried out, or was carried out successfully or not successfully. The assessment of the error value thus also depends, for example on the quality of the reference frequency profile, especially the quality of the engagement process on which the reference frequency profile is based.

According to one additional advantageous exemplary embodiment, the comparing includes correlating the frequency profile to the at least one reference frequency profile. The monitoring of the engagement process may then, for instance, take place based on the correlation values.

The comparing takes place, for example, to a first number of reference frequency profiles, which are each associated with a successfully carried out engagement process, and to a second number of reference frequency profiles which are each associated with an engagement process that was not successfully carried out. Accordingly, the frequency profile may be submitted to a plurality of comparisons, in order to draw a conclusion, from the individual and the total comparison results, upon the quality of the engagement process, and to monitor the engagement process.

In an advantageous manner, for example, that reference frequency profile is ascertained from which the frequency profile has the lowest deviation. The reference frequency profiles lie, for example, in different gradations of the quality of the engagement process on which they are based. With that, for example, the accuracy in the monitoring of the engagement process may be further increased, particularly in the assessment of the quality of the engagement process.

During the carrying out of the engagement process, the sequence in time of various engagement processes may differ, especially some engagement processes may run more rapidly than others. This has the effect of a difference in various signal profiles at exclusive observation in the time range. Such differences, which may, for instance, be a function of the environmental temperature or a battery voltage, may, however, be negligible in the frequency range, so that, even in engagement processes which run at different speeds, a similar frequency profile comes about, for instance, a frequency spectrum. The reference frequency profile, for example, has a certain signature or spectral shape which is independent of the speed at which the engagement process is running. Thereby the quality of the engagement process is able to be ascertained better, and the engagement process may be monitored with greater reliability.

In order to support this, in various advantageous exemplary embodiments the signal profile may be brought to a predetermined number of scanning values before generating a frequency profile, so as to obtain a uniform length in the frequency profile. For example, before generating the frequency profile, the signal profile is submitted to a scanning rate conversion.

The signal profile of an engagement process may change over the service life of the starter motor, so that the signal profile of a successfully carried out engagement process at the beginning of the service life will differ from a signal profile in the case of a successfully carried out engagement process towards the end of the service life. Accordingly, the at least one reference frequency profile may be selected to be adjustable in an advantageous manner, particularly adjustable as a function of the service life of the starter motor. Accordingly, one is also able to ascertain or estimate an expired service life of the starter motor via a comparison to an adjusted reference frequency profile. An instantaneous service life is defined, for example, by the number of already completed starting processes or by the number of faulty starting processes of the starter motor. Alternatively or in addition, the degree of wear of the starter motor may also be determined, especially of the engaging pinion and/or of the associated toothed wheel. With the aid of a measured signal curve, if a certain degree of wear is ascertained, for example, this may be signalized, in order to initiate possible further measures.

In various exemplary embodiments, the result of the quality ascertained and of the monitoring of the engagement process may be evaluated for additional, subsequent actions. For example, at least one of the following is carried out if the engagement process is not ascertained as having been successfully carried out: The signal profile is stored, for example, in order to evaluate it later in common with additional stored signal profiles; an error counter is incremented in order, in the case of a service or an inspection of the starter motor, to be evaluated as information on the wear of the starter motor; the engagement process is broken off and/or started anew, in order to prevent or reduce possible mechanical wear during a faulty engagement process; a warning message is issued, for instance, to a control electronic system, or via the control electronic system to a user.

According to one further aspect, a device is provided for monitoring an engagement process of an engaging pinion of a starter motor for a vehicle drive, in which an armature of the starter motor is being moved. The device includes a sensor, which is designed to detect a magnetic coil signal when a magnetic coil of the magnet is acted upon by a current, in order to receive a signal profile, particularly a current profile, and a processor that is designed to generate a frequency profile by transforming the signal profile using a time-frequency transform, comparing the frequency profile with at least one reference frequency profile, and monitoring the engagement process based on the comparison.

Such a device may, for instance, be advantageously used on vehicles, particularly motor vehicles having internal combustion engines. By ascertaining the property of the engagement process based on the speed, this ascertainment may take place at low temporal delay, particularly already during the engagement process. As a result, such a device may advantageously be used on internal combustion engines having start-stop function, in which a rapid and error-free starting process is meaningful, especially in comparison to usual internal combustion engines without the start-stop function.

The device may, however, also be used with other internal combustion engines, especially slowly coasting down engines or engines having automatic transmissions, independently of whether a start-stop function is implemented for such engines.

Alternatively, the number of zero crossings is determined by an observation method, and not based on the difference profile. The observation method may be a Kalman filtering, for example, including a Kalman filter or a Kalman-like filtering. The observation method may further be based on the use of a real-time model of the mechanical kinematics and of electrical parameters, in order to detect an acceleration or braking of the armature, which may include a coil.

According to one alternative aspect, the present invention relates to a method for monitoring an engagement process of an engaging pinion of a starter motor for a vehicle drive, in which an armature of the starter motor is moved by a magnet, in which generating the frequency profile is replaced by observing the signal profile, in order to obtain an observation profile, and in which the frequency profile is replaced by the observation profile, so that comparing the frequency profile to at least one reference frequency profile is substituted by a comparison of the observation profile to at least one reference frequency profile.

According to one exemplary embodiment, the observation profile is advantageously obtained by Kalman filtering of the signal profile or by the use of a real time model of the mechanical kinematics and/or electrical parameters of the armature and/or of the starter motor.

According to one further alternative aspect, the present invention relates to a device for monitoring an engagement process of an engaging pinion of a starter motor for a vehicle drive, in which an armature of the starter motor is moved by a magnet. The device includes a sensor, which is designed to detect a magnetic coil signal when a magnetic coil of the magnet is acted upon by a current, in order to receive a signal profile, particularly a current profile, and a processor that is designed to generate an observation profile by observing the signal profile, comparing the observation profile with at least one reference frequency profile, and monitoring the engagement process based on the comparison.

According to one exemplary embodiment, the observation profile is advantageously obtained by Kalman filtering of the signal profile or by the use of a real time model of the mechanical kinematics and/or electrical parameters of the armature and/or of the starter motor.

The exemplary embodiments, described above and below, also apply in a meaningful manner, with the substitutions mentioned, for the alternative aspects of the present invention.

Various exemplary embodiments of the device, particularly of the sensor and the processor, come about from the abovementioned exemplary embodiments of the method, which may be implemented using the sensor and the processor.

Exemplary embodiments of the present invention are described in greater detail below with reference to the accompanying drawings.

DETAILED DESCRIPTION

Figure 1:
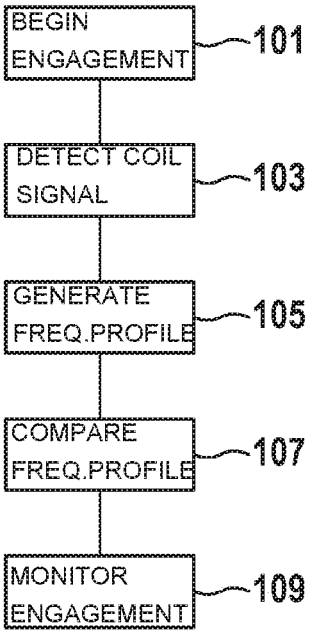
FIG. 1 shows a schematic flow chart of a method for monitoring an engagement process of an engaging pinion.

FIG. 1 shows a schematic flow chart of a method for monitoring an engagement process of an engaging pinion. In a step 101 the engagement process is started, for example, by setting an armature of the starter motor in motion via a solenoid. To do this, a magnetic coil of the solenoid is supplied with current. In a following step 103, a magnetic coil signal is detected when current is applied to a magnetic coil, in order to obtain a signal profile, especially a current profile.

In a step 105, a frequency profile is generated by transforming the signal profiles using a time-frequency transform. For this, one may use, for example, a discrete Fourier transform, especially a fast Fourier transform, FFT, a short-time Fourier transform, STFT, or a wavelet transform. Before the generation of the frequency profile in step 105, the frequency profile may be brought, for example, to a specified number of scanning values, which corresponds to approximately the transformation length of the time-frequency transform. For this, the signal profile is submitted, for example, to a scanning rate conversion.

In a step 107, the frequency profile is compared to at least one reference frequency profile. The comparison preferably takes place to a first number of reference frequency profiles, which are each associated with a successfully carried out engagement process, and a second number of reference frequency profiles, which are each associated with an unsuccessfully carried out engagement process. In a step 109, based on the comparison, the engagement process is monitored, or rather the quality of the engagement process is ascertained.

The comparing in step 107 takes place, for example, by ascertaining an error value, particularly based on a mean square error, between the frequency profile and one or more reference frequency profiles. Alternatively or in addition, the frequency profile may also in each case be correlated with the reference frequency profile.

The quality of the engagement process is, for example, how the engagement process turns out. For example, the engagement process may be carried out in an orderly manner or speedily so as to obtain a successfully carried out engagement process or one that is able to be carried out successfully. If the engagement process differs from such an ideal behavior, however, a faulty engagement process may also be ascertained as the property, various gradations of such a faulty engagement process being possible.

Figure 2A:
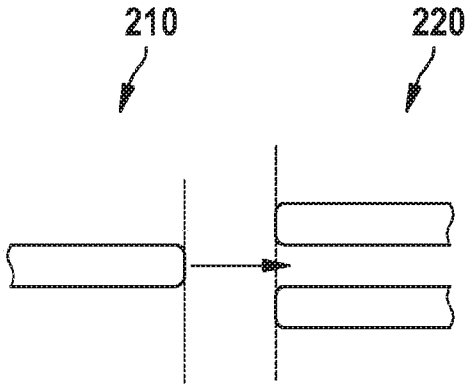
FIGS. 2*a* and 2*b* show a schematic representation of a first exemplary engagement process.
Figure 2B:
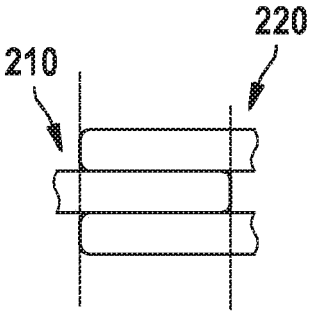

FIGS. 2*a* and 2*b* show in exemplary fashion a schematically represented sequence of a successful engagement process. In this instance, for example, a tooth 210 of the engaging pinion of a starter motor and teeth 220 of a toothed wheel of a vehicle drive that is to be started, for instance, of an internal combustion engine, are shown. In the illustration of FIG. 2*a*, with the aid of the solenoid, for example, a force in the direction of the arrow is exerted on tooth 210, in order to engage it with teeth 220 of the toothed wheel. In this process, tooth 210 is positioned relative to teeth 220 of the toothed wheel such that engagement is able to take place directly and without hindrance. Accordingly, in FIG. 2*b*, tooth 210 of the engaging pinion is shown in the engaged state.

Figure 3A:
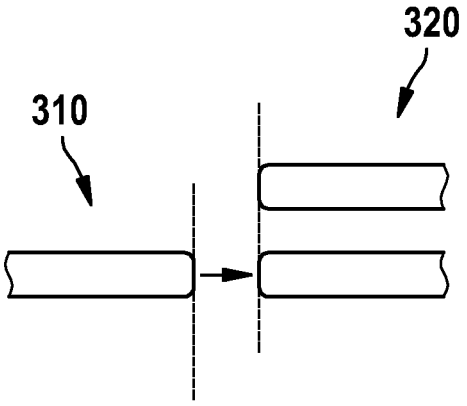
FIGS. 3*a* and 3*b* show a schematic representation of a second exemplary engagement process.
Figure 3B:
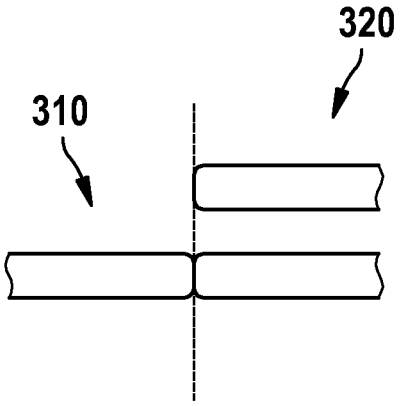

In FIGS. 3*a* and 3*b* there is shown in exemplary fashion a faulty engagement process of a tooth 310 of an engaging pinion with teeth 320 of a toothed wheel. In an initial position shown in FIG. 3*a*, in which tooth 310 is put in motion, it is positioned with respect to the toothed wheel such that tooth 310 lies opposite one of teeth 320. This results, for instance, in a positioning that is shown in FIG. 3*b*, in which tooth 310 impinges on one of teeth 320. In this case, one may speak of a tooth-on-tooth position of the engaging pinion. One may recognize in this instance that there will be no direct engagement of the engaging pinion. The engagement process will rather run at least in a delayed manner, particularly in comparison with an ideally running engagement process. In addition, it is possible in this constellation that the engagement process is not able to be carried out successfully. It may happen, for example, that the engaging pinion begins to turn and the teeth of the engaging pinion exert friction on the teeth of the toothed wheel, and thus a grating noise comes about. Such a process may also be designated as grating of the engaging pinion.

In various exemplary embodiments, in a tooth-on-tooth position it may be required that a meshing spring is overpressed by the teeth of the pinion, which leads to a slower moving in of the armature of the starter motor. Such a slow moving in may result, for one thing, in a later engagement of the engaging pinion into the toothed wheel, or may indicate the so-called grating, that is, a continuous jumping of the pinion on the toothed wheel, which may prevent the starting process.

Figure 4A:
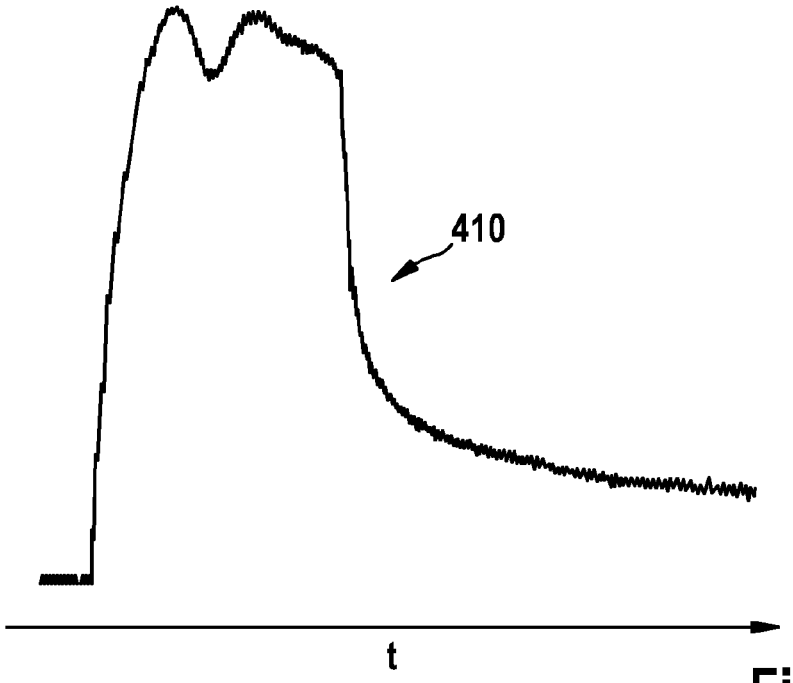
FIGS. 4*a* and 4*b* show exemplary signal profiles of engagement processes.
Figure 4B:
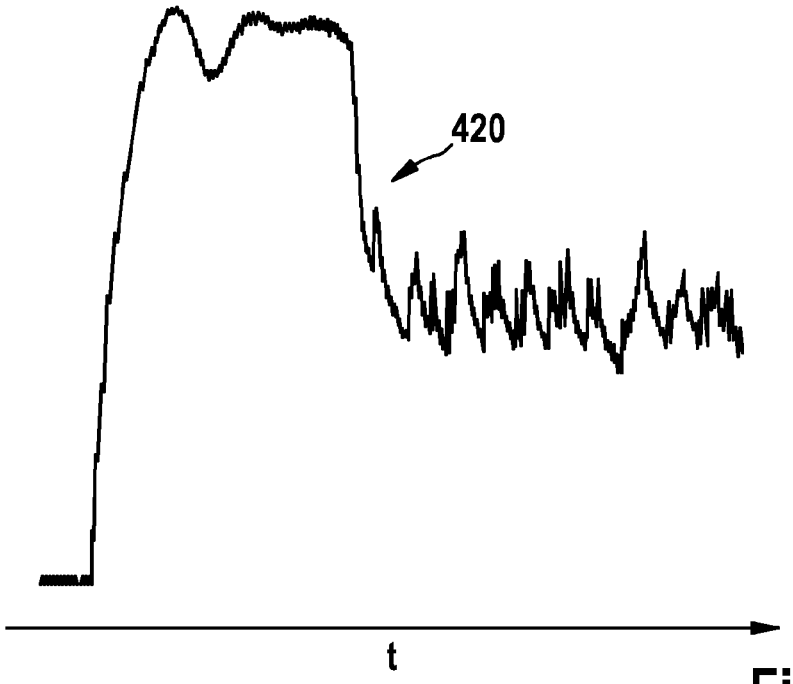

In FIGS. 4*a* and 4*b*, exemplary signal profiles 410, 420 are shown which, for instance, represent a current or a voltage on a starter relay during an engagement process. Signal profile 410 of FIG. 4*a* corresponds to a successfully carried out engagement process, for example. Signal profile 410 rises at first, after the beginning of the engagement process, ending in a first local maximum. After a slight drop to a local minimum, a second rise to a second local maximum takes place, and a following flat decrease limited in time and a subsequent steeper drop having a steady dying away.

Signal profile 420 in FIG. 4*b* represents an unsuccessfully carried out engagement process, in which, after the second local maximum, which is visible similarly as in FIG. 4*a*, an additional local minimum having a subsequent local maximum is recognizable. After the third local maximum in signal profile 420, the signal curve drops steeply and dies away in a jitter. This jitter results, for example, from the fact that the engaging pinion is not able to engage in a clean manner into the toothed wheel of the starter motor, but glides away over it, for example, resulting in each case in a new load or current action on the magnet.

Signal profiles 410, 420 of FIGS. 4*a* and 4*b* in each case represent an example of a successful or not successful engagement process. Further examples of successful and unsuccessful engagement processes may have a similar curve.

Figure 5A:
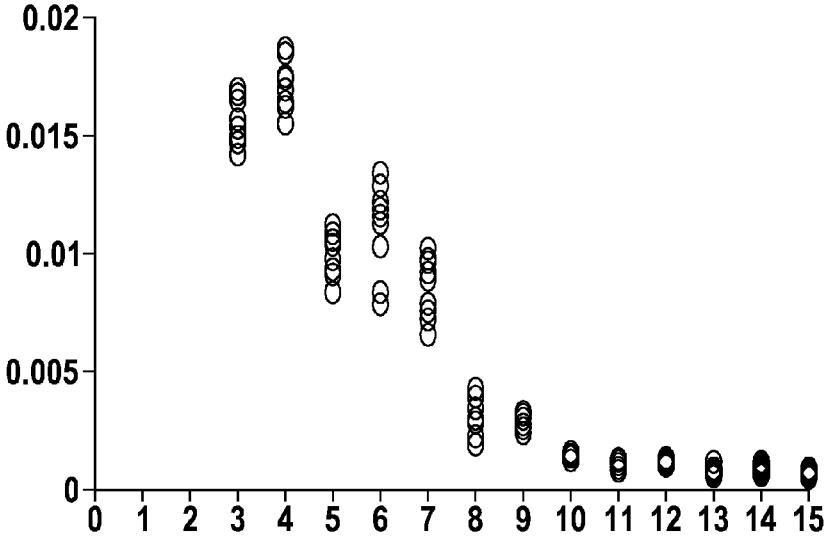
FIGS. 5*a* and 5*b* show exemplary frequency profiles of engagement processes.
Figure 5B:
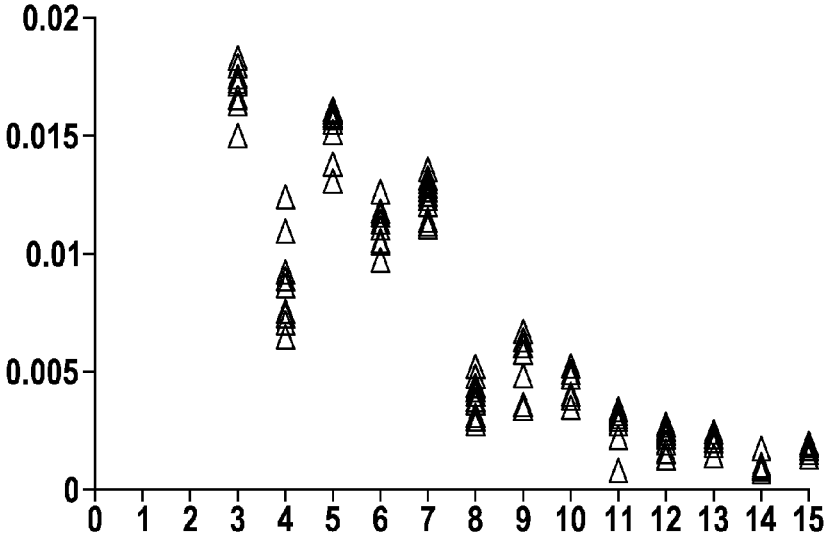

Accordingly, FIGS. 5*a* and 5*b* each show a collection of reference frequency profiles of successful and unsuccessful engagement processes, respectively. The reference frequency profiles in this case are, for instance, shown for the positive frequency range having 16 scanning values, in FIG. 5*a*, spectral points of the reference frequency profiles of successful engagement processes being characterized by circles, and in FIG. 5*b* spectral points of unsuccessful engagement processes being characterized by triangles.

The reference frequency profiles of FIGS. 5*a* and 5*b* are stored, for instance, in a memory of a processing unit or of a processor. A measured signal profile is compared, for example, after its transformation to form the frequency profile, with each of the stored reference frequency profiles, for instance, by correlation or by ascertaining a mean square deviation, in order to find that particular reference frequency profile which has the smallest deviation from the measured frequency profile. Since it is known which quality the found reference frequency profile has, using this information one is able to make a classification of the engagement process that is to be assessed.

Figure 6:
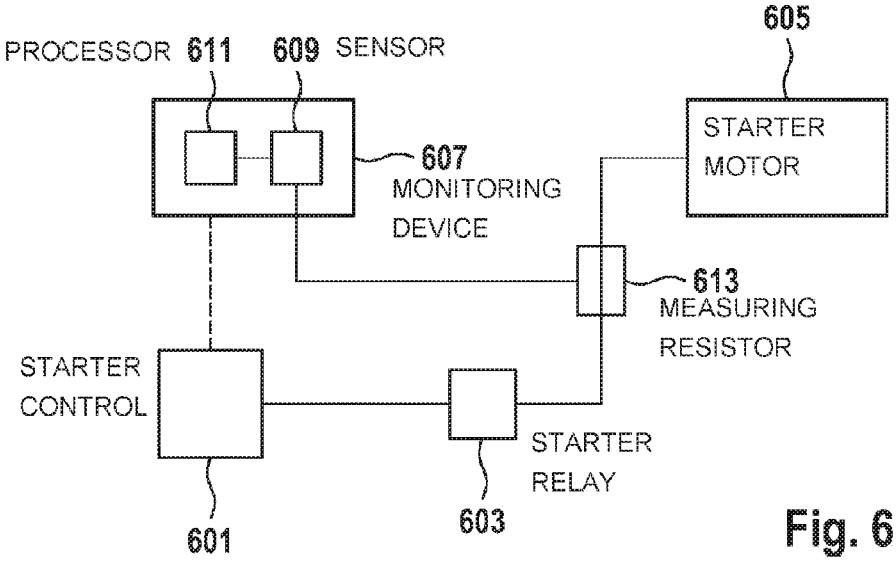
FIG. 6 shows a schematic representation of a device for monitoring an engagement process of an engaging pinion.

FIG. 6 shows a schematic representation of a starter system having a starter control 601, a starter relay 603, and a starter motor 605. The system further includes a monitoring device 607 having a sensor 609 and a processor 611, sensor 609 being connected to a measuring resistor or shunt 613.

Starter control 601 is connected to starter relay 603, in order to trigger a starting process of starter motor 605 via starter relay 603. The starter control may be connected to monitoring device 607, to supply information to device 607 on a starting process that is to be started. Sensor 609 detects a magnetic coil signal via measuring resistor 613, particularly a current, on starter relay 603.

This magnetic coil signal is processed further in processor 611 as a signal profile, and is especially converted to a frequency profile using a time-frequency transform. In addition, in processor 611, the signal profile may be brought to a desired number of scanning values before the transformation, which corresponds to the respective transform, for instance, by a scanning rate conversion. The frequency profile is subsequently compared in processor 611 to one or more stored reference frequency profiles, in order to monitor the engagement process based on the comparison. In this connection, the method is particularly used that was described in the previous figures, which will not be explained further at this point, so as to avoid repetition.

A system as shown in FIG. 6 may advantageously be used particularly in a motor vehicle having an internal combustion engine. Such a system is particularly suitable for engines having a start-stop function, in which the internal combustion engine is stopped, during a standing phase of the vehicle, for instance, during a stop at a traffic light, and, upon a continuation command by the driver, is started anew via the starter motor.

In summary, the present invention provides a method and a device which enable, in particular, that an engagement process of an engaging pinion of a starter motor is monitored such that, in a brief period, a quality of the engagement process is able to be determined, especially as to whether the engagement process is carried out in an error-free or a faulty manner.

What is claimed is:

1. A method for monitoring an engagement process of an engaging pinion of a starter motor for a vehicle drive, in which an armature of the starter motor is moved by a solenoid having a magnet having a magnetic coil, the method comprising:

starting the engagement process by setting the armature of the starter motor in motion via the solenoid, wherein the magnetic coil of the solenoid is supplied with current;

detecting a magnetic coil signal of the magnetic coil when current is applied to the magnetic coil of the magnet, to obtain a signal profile;

generating a frequency profile by transforming the signal profile using a time-frequency transform;

comparing the frequency profile to at least two reference frequency profiles, wherein one of the reference frequency profiles is associated with a successfully carried out engagement process, and another of the reference frequency profiles is associated with an unsuccessfully carried out engagement process; and monitoring the engagement process based on the comparison by ascertaining a quality of the engagement process.

2. The method as recited in claim 1, wherein it is ascertained during the monitoring of the engagement process whether the engagement process is able to be carried out successfully.

3. The method as recited in claim 1, wherein, in response to the generating of the frequency profile, at least one of the following transforms is used:

a discrete Fourier transform, a fast Fourier transform (FFT), a short-time Fourier transform (STFT), and a wavelet transform.

4. The method as recited in claim 1, wherein the comparing includes ascertaining an error value based on a mean square error between the frequency profile and the at least one reference frequency profile.

5. The method as recited in claim 1, wherein the comparing includes correlating the frequency profile with the at least one reference frequency profile.

6. The method as recited in claim 1, wherein the comparing takes place to a first number of reference frequency profiles, which are each associated with a successfully carried out engagement process, and a second number of reference frequency profiles, which are each associated with an unsuccessfully carried out engagement process.

7. The method as recited in claim 1, wherein the monitoring of the engagement process includes ascertaining a particular reference frequency profile from which the frequency profile has a smallest deviation.

8. The method as recited in claim 1, wherein the signal profile is submitted to a scanning rate conversion before the generating of the frequency profile.

9. The method as recited in claim 1, wherein the signal profile is brought to a specified number of scanning values before the generating of the frequency profile.

10. The method as recited in claim 1, wherein the generating of the frequency profile is replaced by observing of the signal profile, so as to obtain an observation profile; and wherein the frequency profile is replaced by the observation profile, and the comparing of the frequency profile to at least one reference frequency profile is replaced by a comparison of the observation profile to at least one reference frequency profile.

11. The method as recited in claim 10, wherein the observation profile is obtained by a Kalman filtering of the signal profile or by using a real-time model of mechanical kinematics and/or electrical parameters.

12. A device for monitoring an engagement process of an engaging pinion of a starter motor for a vehicle drive, wherein an armature of the starter motor is moved by a solenoid having a magnet having a magnetic coil, comprising:

a sensor configured to detect a magnetic coil signal when a current acts on a magnetic coil of the magnet, so as to obtain a signal profile, wherein the engagement process is started by setting the armature of the starter motor in motion via the solenoid, wherein the magnetic coil of the solenoid is supplied with current; and a processor configured to perform the following:

detecting a magnetic coil signal of the magnetic coil when current is applied to the magnetic coil of the magnet, to obtain a signal profile;

generating a frequency profile by transforming the signal profile using a time-frequency transform;

comparing the frequency profile to at least two reference frequency profiles, wherein one of the reference frequency profiles is associated with a successfully carried out engagement process, and another of the reference frequency profiles is associated with an unsuccessfully carried out engagement process; and monitoring the engagement process based on the comparison by ascertaining a quality of the engagement process.

13. A device for monitoring an engagement process of an engaging pinion of a starter motor for a vehicle drive, wherein an armature of the starter motor is moved by a solenoid having a magnet having a magnetic coil, comprising:

a sensor configured to detect a magnetic coil signal when a current acts on a magnetic coil of the magnet, so as to obtain a signal profile, wherein the engagement process is started by setting the armature of the starter motor in motion via the solenoid, wherein the magnetic coil of the solenoid is supplied with current; and a processor configured to perform the following:

detecting a magnetic coil signal of the magnetic coil when current is applied to the magnetic coil of the magnet, to obtain a signal profile;

generating an observation profile by observing the signal profile;

comparing the observation profile to at least two reference frequency profiles, wherein one of the reference frequency profiles is associated with a successfully carried out engagement process, and another of the reference frequency profiles is associated with an unsuccessfully carried out engagement process; and monitoring the engagement process based on the comparison by ascertaining a quality of the engagement process.

14. The device as recited in claim 13, wherein the observation profile is obtained by a Kalman filtering of the signal profile or by using a real-time model of mechanical kinematics and/or electrical parameters.

* * * * *